US011623359B2

(12) United States Patent
Ganey

(10) Patent No.: US 11,623,359 B2
(45) Date of Patent: Apr. 11, 2023

(54) SLICER APPARATUS

(71) Applicant: Randall E. Ganey, Bolivia, NC (US)

(72) Inventor: Randall E. Ganey, Bolivia, NC (US)

( * ) Notice: Subject to any disclaimer, the term of this patent is extended or adjusted under 35 U.S.C. 154(b) by 0 days.

(21) Appl. No.: 17/487,389

(22) Filed: Sep. 28, 2021

(65) Prior Publication Data

US 2022/0097245 A1 Mar. 31, 2022

Related U.S. Application Data

(60) Provisional application No. 63/084,231, filed on Sep. 28, 2020.

(51) Int. Cl.
*B26B 29/06* (2006.01)
*B26D 3/28* (2006.01)

(52) U.S. Cl.
CPC ..... *B26B 29/063* (2013.01); *B26D 3/283* (2013.01); *B26D 2003/287* (2013.01)

(58) Field of Classification Search
CPC ..... B26B 3/04; B26B 29/063; B26B 29/06; B26B 2029/066; B26D 3/20; B26D 3/18; B26D 3/185; B26D 3/24; B26D 3/30; B26D 3/283; B26D 2210/02; B26D 3/03
See application file for complete search history.

(56) References Cited

U.S. PATENT DOCUMENTS 1,098,941 A * 6/1914 Collins ..... B26B 29/063 83/762
2,477,493 A * 7/1949 Olson ..... B26D 3/30 83/761
2,685,901 A * 8/1954 Putzer ..... B26D 3/30 83/870
3,872,757 A 3/1975 Hargadon
4,112,834 A 9/1978 Thiry
4,624,166 A 11/1986 Kreth et al.
D294,795 S 3/1988 Hassenfelt, Jr.
5,101,716 A 4/1992 Cones, Sr. et al.
5,881,784 A 3/1999 Morikawa et al.
5,890,291 A * 4/1999 Crum ..... B26D 7/1854 30/92
6,318,222 B1 11/2001 Weinman, Jr.
7,455,005 B2 11/2008 Giessler
7,757,602 B2 7/2010 Aubry et al.
(Continued)

FOREIGN PATENT DOCUMENTS

DE 559460 C * 9/1932
DE 102010014421 A1 * 10/2011 ..... B26B 29/063
FR 2726780 A1 * 5/1996 ..... B26D 3/283
(Continued)

*Primary Examiner* — Jennifer S Matthews
(74) *Attorney, Agent, or Firm* — P. Jeff Martin; The Law Firm of P. Jeffrey Martin, LLC

(57) ABSTRACT

A manually-operated, foodstuff slicer includes a top plate and bottom plate coupled together and housing a cutting blade within a recess formed between the plates. The top plate and bottom plate include spaced, circular holes defined therethrough and axially aligned, respectively, and the planar cutting blade having a handle and a plurality of circular holes which correspond in size and shape to the holes defined through the top and bottom plates. The blade is slidably retained between the top and bottom plates and movable along a plane similar to the plates.

12 Claims, 13 Drawing Sheets

(56) References Cited

U.S. PATENT DOCUMENTS

| | | | | |
|---|---|---|---|---|
| 8,495,941 | B2 * | 7/2013 | Farid | B26D 7/0608 83/633 |
| 2017/0297215 | A1 * | 10/2017 | Lopez | B26D 5/10 |

FOREIGN PATENT DOCUMENTS

| | | | | |
|---|---|---|---|---|
| KR | 200321839 | Y1 * | 7/2003 | |
| WO | WO-2013026841 | A1 * | 2/2013 | B26B 29/063 |
| WO | WO-2018183912 | A1 * | 10/2018 | |

* cited by examiner

SLICER APPARATUS

I. RELATED APPLICATIONS

This application claims priority to U.S. Provisional Patent Application No. 63/084,231, filed on Sep. 28, 2020, the disclosure of which is hereby incorporated by reference in its entirety.

II. FIELD OF THE INVENTION

The present application discloses and describes present application discloses and describes an apparatus and/or system configured for simultaneous slicing of foodstuff material into multiple items or units.

III. MOTIVATION OF THE INVENTOR

Many attempts have been made to provide food preparation slicers. However, the previous attempts and/or currently available options include ongoing deficiencies that limit and/or reduce the efficiency by which food preparation is managed. Despite these numerous attempts, there is still a need and desire for improved apparatuses, techniques, and systems for foodstuff preparation tools and devices.

A search of the prior art did not disclose any patents that read directly on the claims of the instant invention; however, the following references were considered related:

U.S. Pat. No. 7,455,005 B2, issued in the name of Giessler;

U.S. Pat. No. 7,757,602 B2, issued in the name of Aubry et al.;

U.S. Pat. No. 4,624,166, issued in the name of Kreth et al.;

U.S. Pat. No. 6,318,222 B1, issued in the name of Weinman, Jr.;

U.S. Pat. No. 3,872,757, issued in the name of Hargadon;

U.S. Pat. No. D294,795, issued in the name of Hassenfelt, Jr.;

U.S. Pat. No. 5,881,784, issued in the name of Morikawa et al.;

U.S. Pat. No. 5,101,716, issued in the name of Cones, Sr. et al.; and

U.S. Pat. No. 4,112,834, issued in the name of Thiry.

This application presents claims and embodiments that fulfill a need or needs not yet satisfied by the products, inventions and methods previously or presently available. In particular, the claims and embodiments disclosed herein describe a multi-slicing foodstuff device, the device comprises a top plate mutually coupled with a bottom plate, the plates forming a housing and having a recess formed between the plates, the recess housing a planar cutting blade; a reciprocating blade guide arm coupled with the planar cutting blade, the blade guide arm manually controlling the movement of the cutting blade; a plurality of apertures formed in the plates, the plurality of apertures mutually aligned in an axial orientation relative to one another; a handle; and a stabilizer assembly for supporting the multi-slicing device in an elevated, fixed orientation, the multi-slicing foodstuff device of the present invention providing unanticipated and nonobvious combination of features distinguished from the devices, apparatuses, inventions and methods preexisting in the art. The applicant is unaware of any device, apparatus, method, disclosure or reference that discloses the features of the claims and embodiments disclosed herein, and as more fully described below.

IV. SUMMARY OF THE INVENTION

In one embodiment, a multi-slicing foodstuff device is disclosed. The multi-slicing foodstuff device includes a top plate mutually coupled to a bottom plate. The top and bottom plates form a housing having a recess formed between the plates. The recess is adapted and configured to house a planar cutting blade.

A guide arm is coupled to the planar cutting blade. The guide arm provides a means for manually controlling the movement of the cutting blade.

A plurality of apertures is formed in the top and bottom plates, wherein the plurality of apertures is mutually aligned in an axial orientation relative to one another.

The multi-slicing foodstuff device further includes a handle formed at the proximal end of the multi-slicing foodstuff device, and a plurality of stops for controlling the linear cutting distance of the cutting blade.

A stabilizer assembly is provided for supporting the multi-slicing foodstuff device in an elevated, fixed orientation.

V. BRIEF DESCRIPTION OF THE DRAWING(S)

The advantages and features of the present invention will become better understood with reference to the following more detailed description and claims taken in conjunction with the accompanying drawings, in which like elements are identified with like symbols, and in which:

FIG. 1*a* is a top plan view of the foodstuff slicer device depicting a right-handed orientation with the guide arm in a retracted position;

FIG. 1*b* is a top plan view of the foodstuff slicer device depicting a right-handed orientation with the guide arm in an advanced position;

FIG. 1*c* is a bottom plan view of the foodstuff slicer device depicting a left-handed orientation with the guide arm in an advanced position;

FIG. 1*d* is a top plan view of the foodstuff slicer device depicting a right-handed orientation with the guide arm in an advanced position with the blade advanced;

FIG. 1*e* is a top plan view of the foodstuff slicer device depicting a right-handed orientation with the guide arm in an advanced position with the blade advanced rightward relative to FIG. 1*d;*

Figure 4:
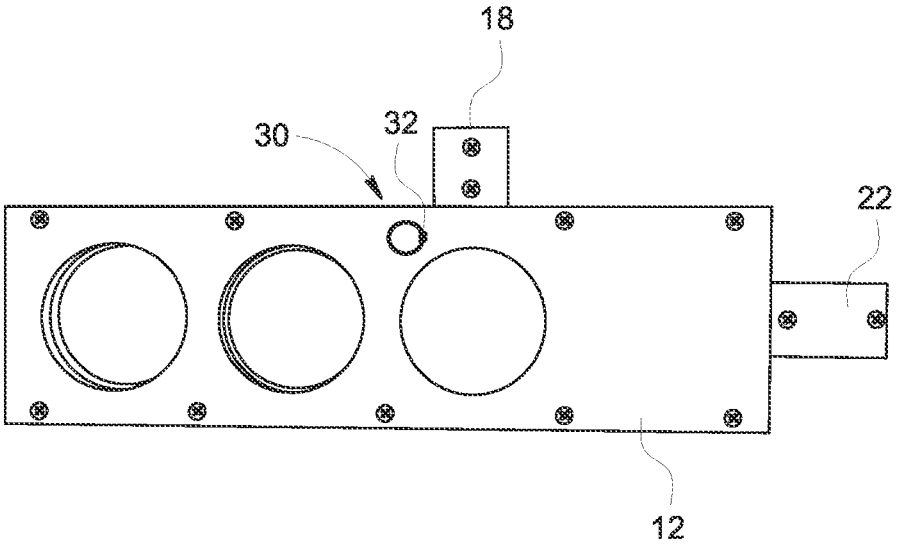
FIG. 4 is a top plan view of the foodstuff slicer device illustrating a safety lock, in accordance to another embodiment of the present invention.
Figure 4A:
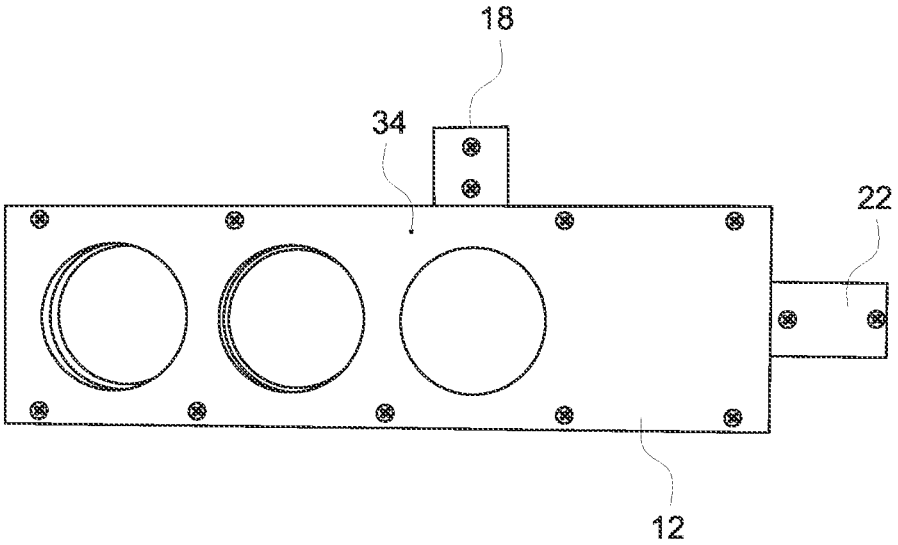
Figure 4B:
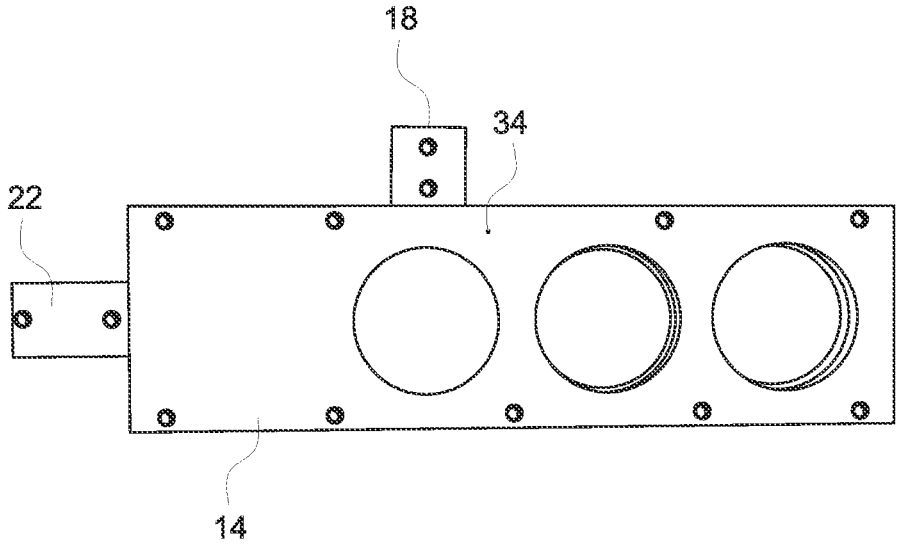
Figure 5:
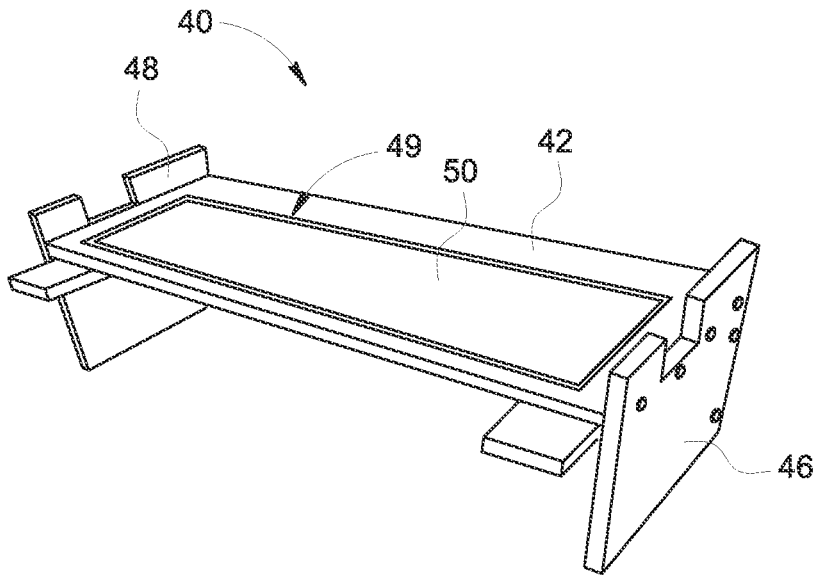
Figure 6:
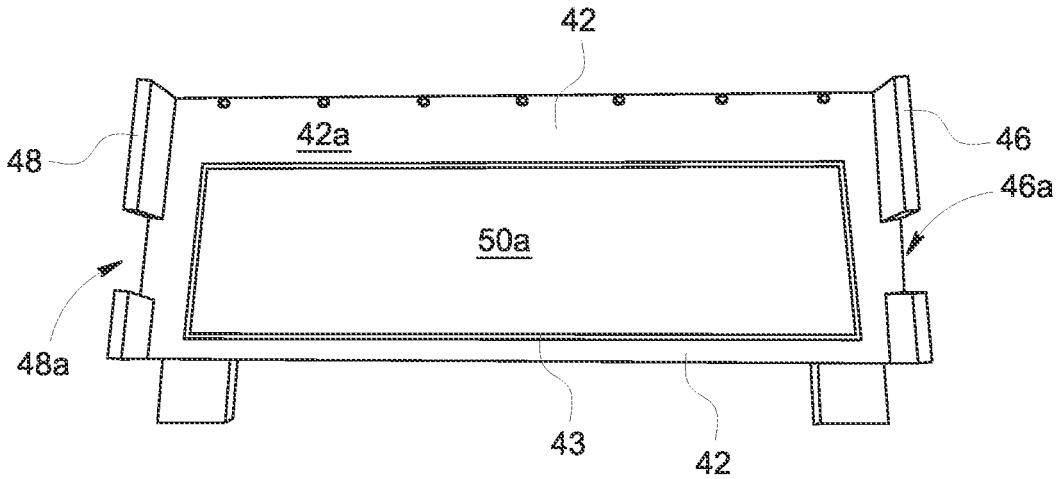
Figure 7:
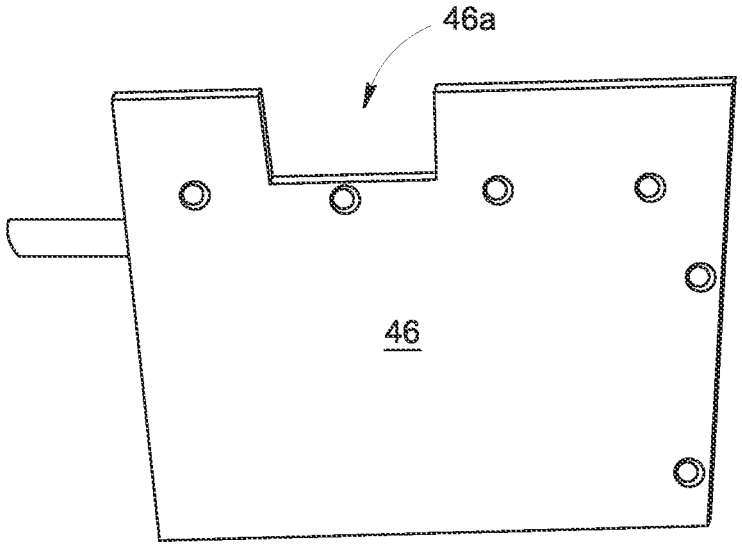
Figure 8:
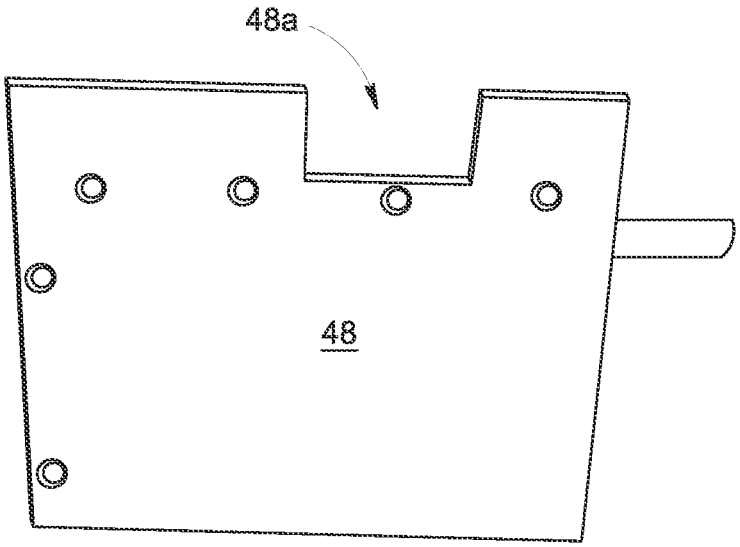
Figure 9:
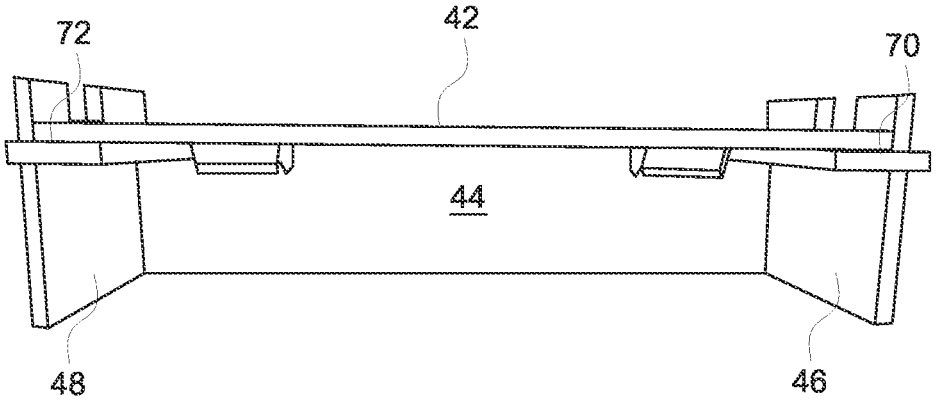
Figure 10:
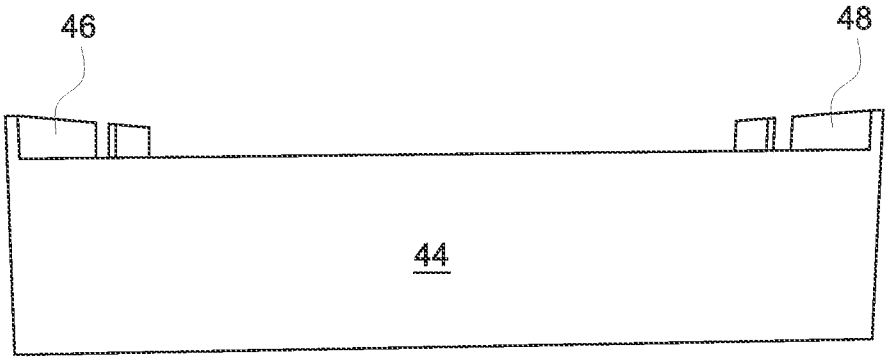
Figure 11:
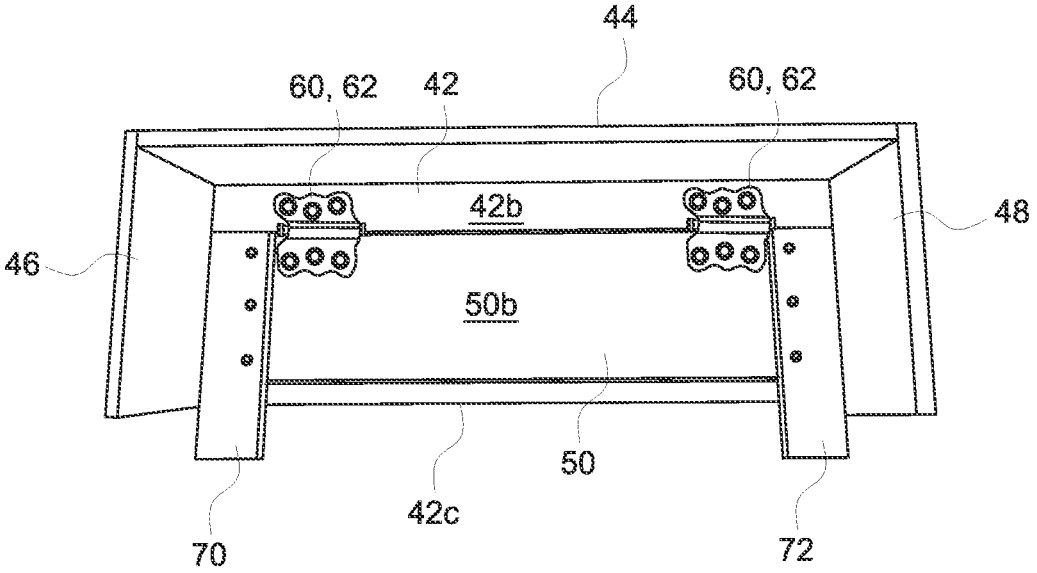
Figure 12:
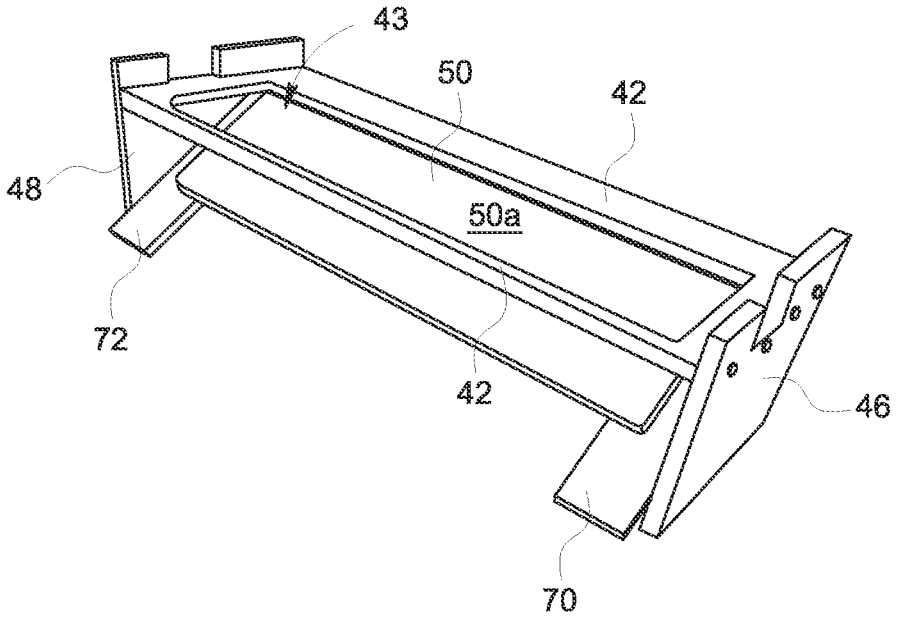
Figure 13:
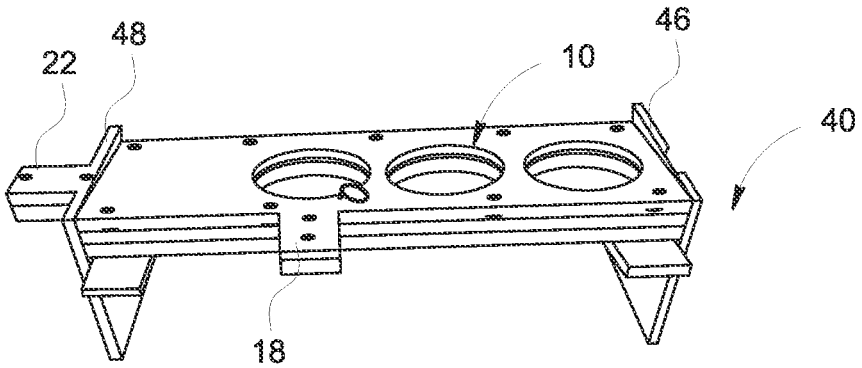
Figure 14:
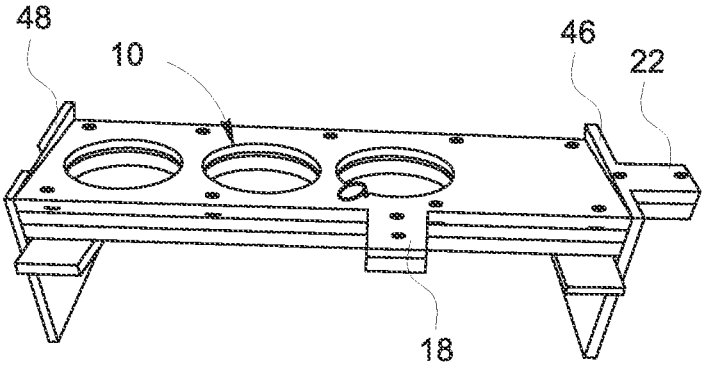

FIG. 4*a* is a top plan view of the device of FIG. 4 shown with the pin of the safety lock removed to illustrate a pin receiving hole;

FIG. 4*b* is a bottom plan view of the device of FIG. 4*a* illustrating the pin receiving hole;

FIG. 5 is a left, front perspective view of a stabilizer assembly for supporting the multi-slicing device, in accordance to one embodiment of the present invention;

FIG. 6 is a top plan view of the stabilizer assembly of FIG. 5;

FIG. 7 is a left side elevational view of the stabilizer assembly of FIG. 5;

FIG. 8 is a right side elevational view of the stabilizer assembly of FIG. 5;

FIG. 9 is a front view of the stabilizer assembly of FIG. 5;

FIG. 10 is a rear view of the stabilizer assembly of FIG. 5;

FIG. 11 is a bottom plan view of the stabilizer assembly of FIG. 5;

FIG. 12 is a left, front perspective view of the stabilizer assembly illustrating a pivoting platform pivoted downwardly to a fully declined orientation, in accordance to one embodiment of the present invention;

FIG. 13 is a front perspective view showing the multi-slicing device supported atop the stabilizer, the multi-slicing device depicted in a right-handed user orientation; and FIG. 14 is a front perspective view showing the multi-slicing device supported atop the stabilizer, the multi-slicing device depicted in a left-handed user orientation.

VI. DESCRIPTION OF THE EMBODIMENT(S)

Consistent with FIGS. 1*a*-1*e*, 2, and 3, a multi-slicing device 10 is disclosed and described. The device 10 comprises a housing 11 comprising a top plate 12 and a bottom plate 14, the top plate 12 mutually coupled with the bottom plate 14. The top plate 12 is mounted spatially superjacent the bottom plate 14 forming a narrow recess 15 therebetween. Plates 12 and 14 form the housing 11 and the recess 15 receives, houses, and retains a planar cutting blade 23. The planar cutting blade 23 is manually controlled and slidably adjusted via a blade guide arm 18. Each plate 12, 14 comprises a plurality of apertures 16 mutually aligned in an axial orientation relative to one another. The housing 11 (formed by plates 12 and 14) is manually controlled and secured by a handle 22 (described in greater detail hereinbelow), wherein the handle 22 is formed and disposed at an end of the device 10.

An appendage 20, 21 extends integrally coplanar from an end wall 12*a*, 14*a* of the top plate 12 and bottom plate 14, respectively, wherein the appendages 20 and 21 collectively form the handle 22.

The plates 12, 14 (forming and defining the housing 11) each separately comprise a plurality of apertures 16, wherein the top plate 12 includes apertures 16*a*, and wherein the bottom plate 14 includes apertures 16*b*. As but one non-exhaustive example, and as depicted in FIGS. 1*a*-1*e*, the device 10 comprises three apertures 16*a* formed and disposed within top plate 12 and three apertures 16*b* formed and disposed within bottom plate 14. For ease of orientation, the three apertures may be labeled (respectively) as proximal aperture(s) nearest the handle 22, distal aperture(s) farthest away from the handle 22, and intermediate aperture(s) disposed between the proximal and distal apertures in a three aperture configuration.

Each aperture 16*a* disposed within top plate 12 comprises the same shape and diameter and is arranged equidistant from an adjacent aperture 16*a* therein. Similarly, each aperture 16*b* disposed within bottom plate 14 comprises the same shape and diameter and is arranged equidistant from an adjacent aperture 16*b* therein. As depicted, the apertures 16*a*, 16*b* are represented as circular, disk-shaped openings into and through the respective plates 12, 14. Alternatively, it is envisioned that other shapes and dimensions are contemplated and within the scope and spirit of the disclosure. In particular, the apertures 16*a* and 16*b* may comprise a variety of diameters for forming foodstuff items of varying diameters. It is further envisioned that the apertures 16*a*, 16*b* are adjustable for forming the differently dimensioned foodstuff items noted in greater detail hereinbelow.

Each aperture 16*a* of top plate 12 is mutually aligned in an axial orientation with each aperture 16*b* of the bottom plate 14, forming a fixed pathway or route through the device 10 whether entry is through the apertures 16*a* of top plate 12 or through apertures 16*b* of bottom plate 14. Because of this mutually aligned arrangement in an axial orientation, the device 10 is reversible and accommodates ambidextrous utilization by right-handed and left-handed users alike.

The planar cutting blade 23 resides between the top plate 12 and the bottom plate 14 and within the recess 15 defined between the plates 12, 14. The blade 23 comprises a similar form, including dimensions and shapes, as the plates 12, 14, such that the blade 23 comprises apertures 24. As but one non-exhaustive example, and consistent with the images and descriptions of the device 10 and plates 12, 14 represented in FIGS. 1*a*-1*e*, the blade 23 comprises three apertures 24 formed and disposed therein. The blade 23 is manually controlled by a blade guide arm 18 coupled therewith. Consistent with FIGS. 1*a*-1*e* and 3, the guide arm 18 is externally oriented to the housing (formed from plates 12, 14), and is oriented to effectuate leftward and rightward (reciprocal) travel T by physically moving the guide arm 18 toward one end of the device 10 and then moving the guide arm 18 toward the opposing end of the device 10.

In a retracted (or starting/initial) position, the intermediate and distal apertures 24 of the blade 23 are mutually aligned in axial orientation with the proximal and distal apertures 16*a* of top plate 12 and with the proximal and distal apertures 16*b* of bottom plate 14, and with the proximal aperture 24 of the blade 23 retracted and hidden from view within the recess 15 between plates 12, 14 adjacent the handle 22. In this retracted (starting/initial) position, ingress and egress through the device 10 is unimpeded regardless of the entry point (whether through the top plate 12 or the bottom plate 14), with the distal apertures 16*a*, 16*b* of top plate 12 and bottom plate 14 not interfacing with the blade 23 (and distal aperture 24) and with the proximal and intermediate apertures 16*a*, 16*b* interfacing with intermediate and distal apertures 24 of blade 23 without occlusion.

In an extended (advanced) position, in which the apertures 24 of blade 23 are misaligned relative to apertures 16*a*, 16*b* (of plates 12, 14), the blade 23 imparts a cutting action on the foodstuff item inserted through the device 10 and effectuates the intended or desired division. Thus, at initial extension, the blade 23 begins to cut the foodstuff item; at intermediate extension, the blade 23 is approximately halfway to completing the desired cut of the foodstuff item; and at full extension, the blade 23 completes the desired cut of the foodstuff item. At full extension, the blade 23 has converted the raw foodstuff material into multiple, smaller units that can be packaged or prepared as desired. Consistent with the non-exhaustive example provided above, in a three aperture (16*a*, 16*b*, 24) embodiment of device 10, the raw foodstuff material is converted from a single large aggregate to six smaller units with one forward advance of blade 23 between top plate 12 and bottom plate 14.

Figure 3:
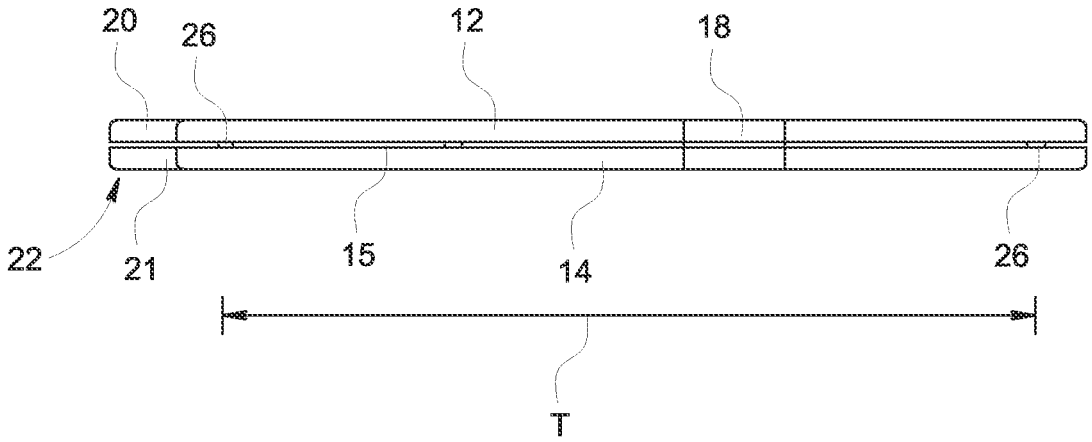
FIG. 3 is a side elevation view of the device.

The blade 23 pathway, particularly the length of the extension and retraction pathway, is controlled by a plurality of stops 26 positioned within the housing (as formed by plates 12, 14). In one arrangement, the stops 26 are positioned at the proximal and distal ends of the housing (and plates 12, 14), with the distal stop(s) 26 impeding advance distally and away from the handle 22 and with the proximal stop(s) 26 impeding retraction proximally and toward the handle 22, as best depicted in FIG. 3.

The handle 22 is formed at one end of the device 10. The handle 22 provides manual control of the device 10 for ease of orientation and movement. During use, with slicing of foodstuff introduced into the apertures 16*a*, 16*b*, and engaging with blade 23 and apertures 24, the handle 22 can be used to provide security and steadiness as the guide arm 18 is advanced and retracted to slice the foodstuff into smaller units for packaging and/or other preparation.

All elements of the device 10 are constructed from USDA-approved, food-quality or food-grade materials, such as high density polyethylene (HDPE) for the housing 11 (formed by top plate 12 and bottom plate 14) and/or stainless steel for the cutting blade 23. Utilizing USDA-approved (and food-quality) materials provides elevated safety in the handling, preparation, and finishing of any foodstuff.

Figure 1A:
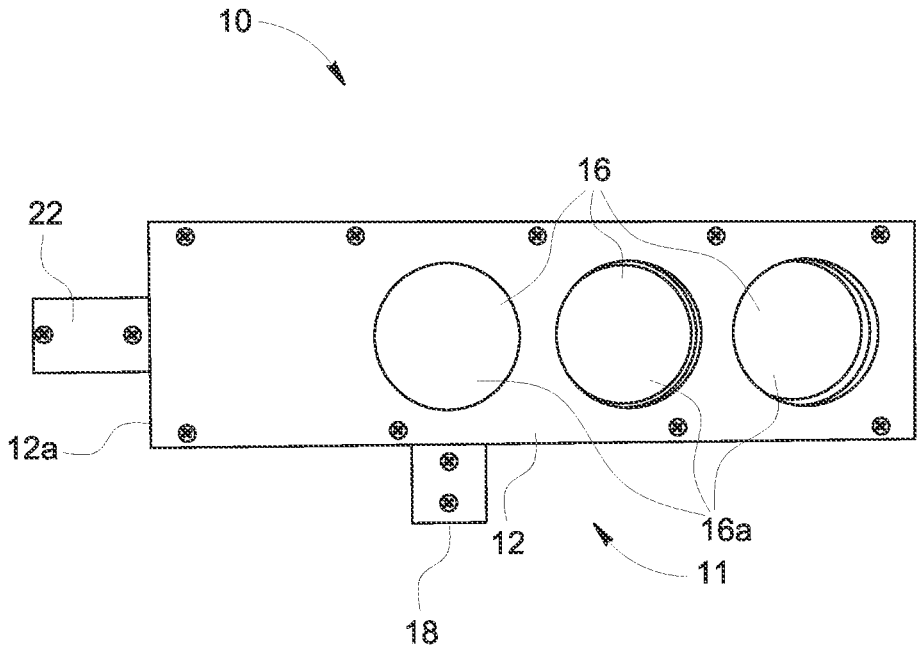
Figure 1B:
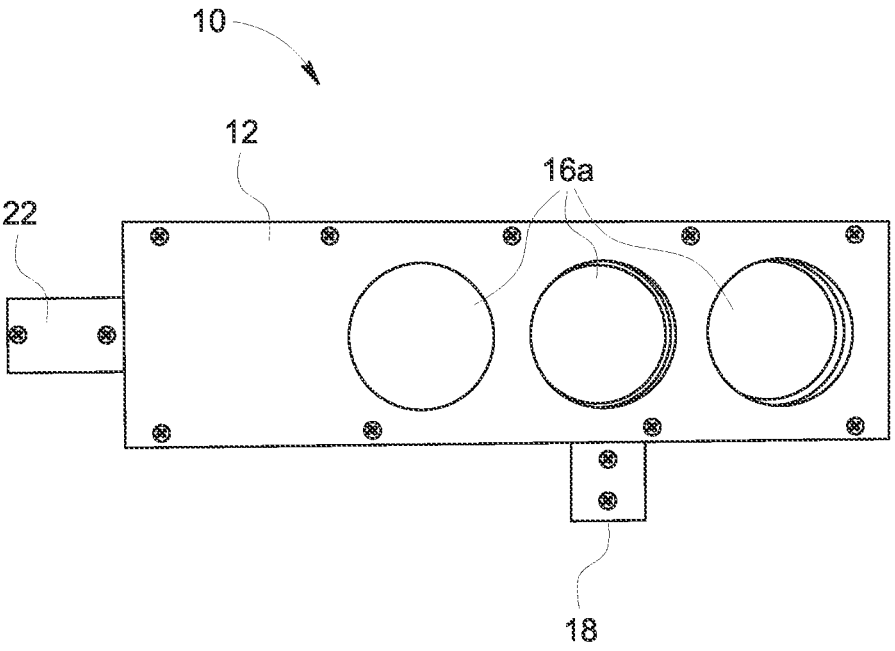
Figure 1C:
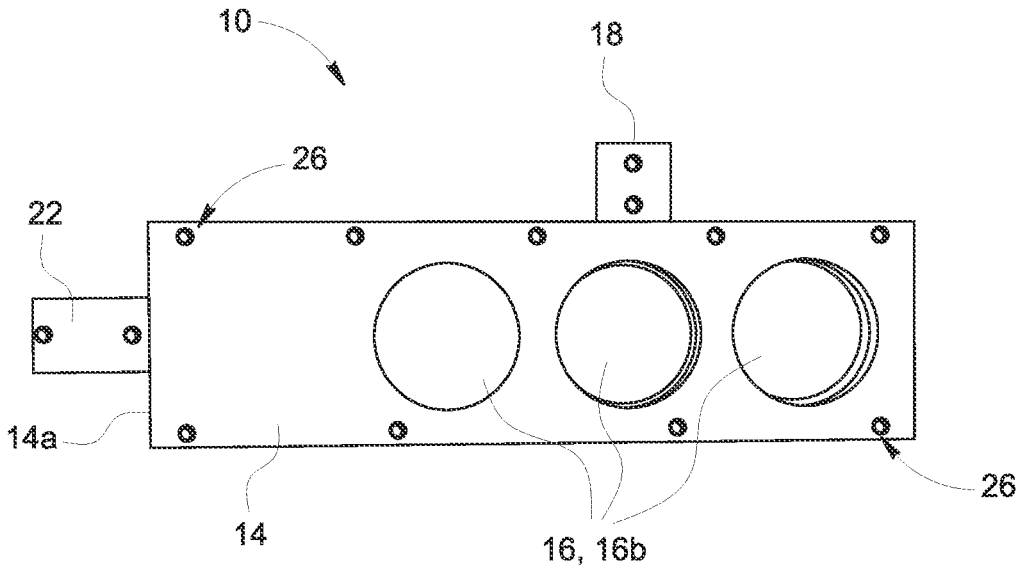
Figure 1D:
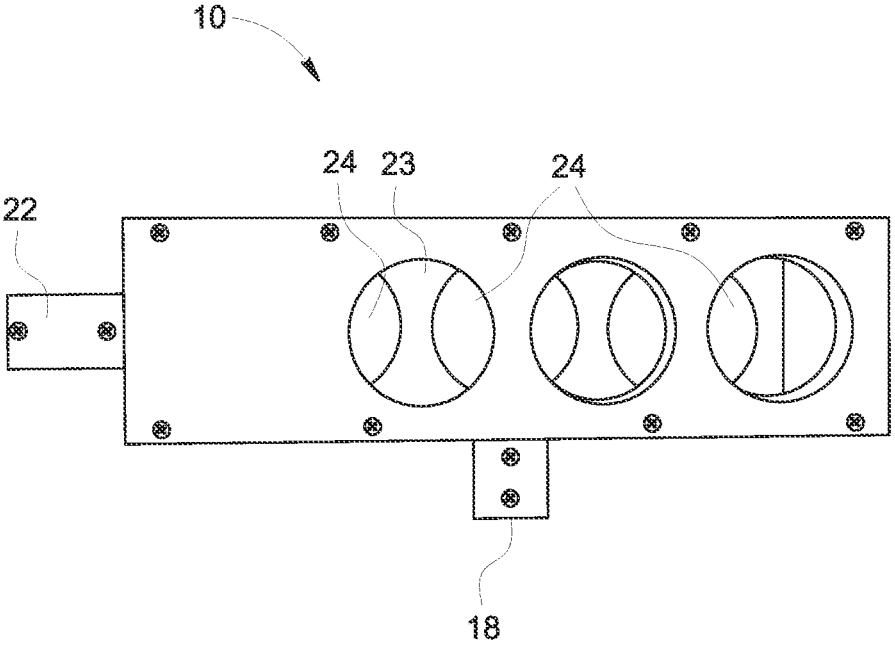
Figure 1E:
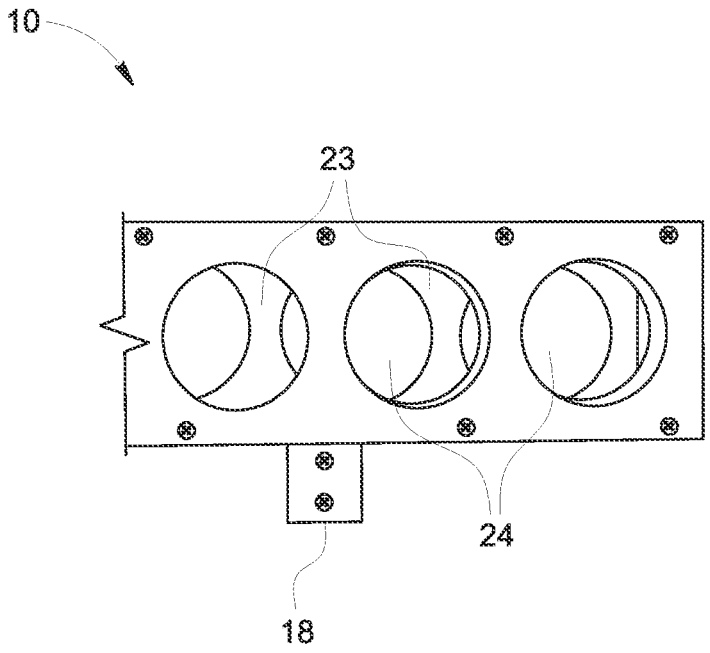
Figure 2:
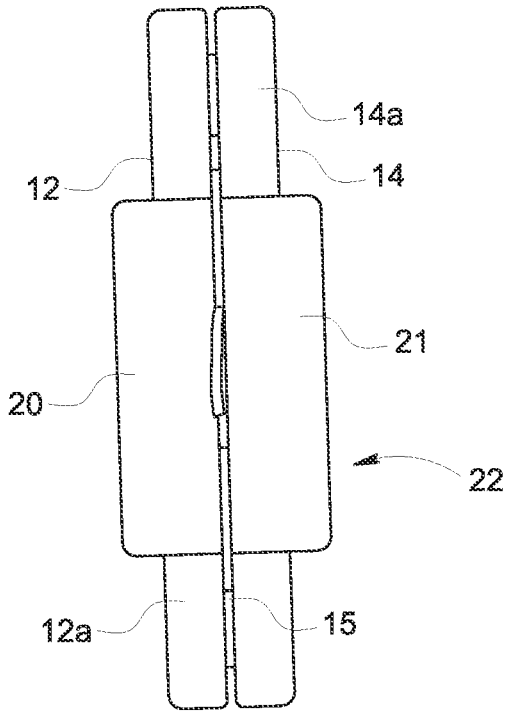
FIG. 2 is bottom elevation view of the device with the handle in view.

The ambidextrous utility of the device 10 is best understood and illustrated by evaluating FIGS. 1*a*, 1*b*, 1*d*, and 1*e* as compared to FIG. 1*c*. In FIGS. 1*a*, 1*b*, 1*d*, and 1*e*, the device 10 is arranged with a right-handed orientation, wherein the handle 22 is grasped in the user's left hand and the user's right hand is free to advance and retract the guide arm 18 and control the blade 23 within the recess 15 between plates 12, 14. In FIG. 1*c*, the device 10 is reversed by turning the article over, wherein the handle 22 remains in the same general orientation but the guide arm 18 is now positioned on the left-hand side and in a left-hand orientation. Thus, consistent with FIG. 1*c*, and its left-handed orientation, a user can grasp the handle 22 with the right handle and use the left-hand to advance and retract the guide arm 18 and control the blade 23 within the recess 15 between plates 12, 14.

In reference to FIGS. 4-4*b*, in order to lock the cutting blade 23 in a securably-fixed position to protect the operator from accidental injury or harm from the cutting blade 23 during periods when manipulating the device 10, but not during a foodstuff cutting event, a safety lock 30 is provided. The safety lock 30 comprises a pin 32 with an annular handle and a pin receiving hole 34 extending linearly through the top plate 12, planar cutting blade 23, and bottom plate 14. Regarding a right-handed user of the multi-slicing device 10, the user inserts the pin 32 into the pin receiving hole 34 through the top plate 12, through the cutting blade 23, and through the bottom plate 14, thereby effectively locking the cutting blade 23 in a secured, fixed position. For a left-handed user of the multi-slicing device, the user inserts the pin 32 into the pin receiving hole 34 through the bottom plate 14, through the cutting blade 23, and through the top plate 12, thereby effectively locking the cutting blade 23 in a secured, fixed position.

Referring now more particularly to FIGS. 5-14, a stabilizer assembly 40 is disclosed for supporting the multi-slicing device 10 in an elevated, fixed orientation. The stabilizer assembly 40 comprises a top wall 42, a rear vertical wall 44, a first vertical sidewall 46, and a second vertical sidewall 48, the rear vertical wall 44 being mounted orthogonally to a lower surface, rear edge of the top wall 42. The first vertical sidewall 46 is mounted perpendicularly to an end or first end of the top wall 42 and the second vertical sidewall 48 is mounted perpendicularly to the opposing end or second end of the top wall 42 constituting an H-shaped configuration. The top wall 42 comprises a generally flat configuration having a planar upper surface 42*a* and a planar lower surface 42*b*. The first vertical sidewall 46, the second vertical sidewall 48 and top wall 42 provide a support compartment 49 within which the multi-slicing device 10 seats in a snug-fit, planar orientation (as illustrated in FIGS. 13 and 14). For purposes of this disclosure, the term "snug-fit" is defined as a substantially-intimate, close-fitting relationship.

The first vertical sidewall 46 and the second vertical sidewall 48 include a handle receiving recess 46*a* and 48*a*, respectively. As depicted in FIG. 13, when the device 10 is used by a right-handed operator, the handle 22 is positioned within handle receiving recess 48*a* of the second vertical sidewall 48, thereby securing the device 10 in a fixedly-secured position and thereafter, the operator uses operator's right hand to advance and retract the guide arm 18 and thus control the blade 23 within the recess 15 between the top plate 12 and the bottom plate 14. Alternatively, as shown in FIG. 14, when the device 10 is used by a left-handed operator, the handle 22 is positioned within handle receiving recess 46*a* of the first vertical sidewall 46, thereby securing the device 10 in a fixedly-secured position and thereafter, the operator uses operator's left hand to advance and retract the guide arm 18 and thus control the blade 23 within the recess 15 between the top plate 12 and the bottom plate 14.

The top wall 42 comprises an enlarged void 43 defined therethrough for accommodating and being occupied by a pivoting platform 50. The platform 50 comprises a generally flat configuration having a planar upper surface 50*a* opposing a planar lower surface 50*b*. The platform 50 is pivotally mounted via a hinge mechanism 60 to the planar lower surface 42*b* of the top wall 42, proximate the rear vertical wall 44. The hinge mechanism 60 comprises at least one biased hinge 62, and preferably comprises a pair of biased hinges 62. The platform 50 is hingedly coupled to the top wall 42 via the pair of spring-biased hinges 62, the pair of spring-biased hinges 62 being spatially mounted. More specifically, the pair of spring-biased hinges 62 is spatially-mounted to the rear portion of the planar lower surface 42*b* of the top wall 42, proximate the rear vertical wall 44 and to the rear portion of the planar lower surface 50*b* of the platform 50, as depicted in FIG. 11. In a resting position, the hinge mechanism 60 (pair of spring-biased hinges 62) is biased to urge the platform in a coplanar relationship with the top wall 42. More particularly, the pair of spring-biased hinges 62 urges the planar upper surface 50*a* of the platform 50 in a coplanar relationship with the planar upper surface 42*a* of the top wall 42 (as best illustrated in FIGS. 5 and 9).

A first linearly-elongated handle member 70 and a second linearly-elongated handle member 72 are provided for manually pivoting the platform 50 downwardly to a declined orientation. In FIG. 12, the platform 50 is depicted in a fully declined orientation or position. The first linearly-elongated handle member 70 and the second linearly-elongated handle member 72 are mounted to the planar lower surface 50*b*, proximate opposing side edges of the platform 50, in a distal and parallel orientation. The first linearly-elongated handle member 70 and the second linearly-elongated handle member 72 each comprises a length so as to project forwardly a distance from a forward edge 42*c* of the top wall 42, thereby allowing quick, easy, and efficient manipulation thereof by the operator.

During a foodstuff cutting event, such as the transverse cutting or slicing of biscuits, the user seats the multi-slicing device 10 in the support compartment 49 (formed by the first vertical sidewall 46, second vertical sidewall 48 and top wall 42) within which the device 10 is seated in a snug-fit, planar orientation. In the event user is right-handed, the handle 22 is positioned within handle receiving recess 48*a* of the second vertical sidewall 48. If the user is left-handed, the handle 22 is positioned within handle receiving recess 46*a* of the first vertical sidewall 46. Next user positions a biscuit (not shown) in each of the plurality of apertures 16*a* and 16*b* disposed in the top plate 12 and bottom plate 14, respectively. User then advances and retracts the guide arm 18 toward one end of the device 10 and then moves the guide arm 18 toward the opposing end of the device 10, and thus effectively slicing each of the biscuits in half. More simply, user moves the guide arm 18 rightward toward one end of the device 10 and then leftward toward an opposing end of the device 10, or the user moves the guide arm 18 leftward toward one end of the device 10 and then rightward toward an opposing end of the device 10. Once the foodstuff has been sliced, user presses downward on either of the first linearly-elongated handle member 70 or the second linearly-elongated handle member 72 so as to pivotally position the platform 50 downwardly to a fully declined orientation (illustrated in FIG. 12), while the multi-slicing device remains in a stationary, fixedly-secured position. User continues to apply the downward force necessary to maintain the platform 50 in the fully declined orientation so as to allow the sliced foodstuff (e.g., biscuits) to slide downwardly from the planar upper surface 50*a* of platform 50 and into a receiving tray, onto a countertop, or the like (neither of which shown). After all biscuits have slid from atop the planar upper surface 50 of platform 50, the user slowly decreases the downward force applied to the first linearly-elongated handle member 70 or the second linearly-elongated handle member 72 sufficient to allow the planar upper surface 50*a* of the platform 50 to be urged, via hinge mechanism 60, to a coplanar relationship with the planar upper surface 42*a* of the top wall 42 absent manual, upward pivotal manipulation by the user.

All elements of the stabilizer assembly 40 are constructed from USDA-approved, food-quality or food-grade materials, such as high density polyethylene (HDPE) for the top wall 42, the rear vertical wall 44, the first vertical sidewall 46, the second vertical sidewall 48, and the pivoting platform 50, and/or stainless steel for the hinge mechanism 60.

It is envisioned that foodstuff items may include a variety of materials. For example, any food or foodstuff originating as dough, including the many forms of bread that can be divided into smaller units are suitable for use within the device 10. Thus, many types of bread-based end products, such as biscuits, rolls, and related items are particularly well-suited for the device. It is also envisioned that other similarly formed foodstuff are suitable.

It is to be understood that the embodiments and claims are not limited in application to the details of construction and arrangement of the components set forth in the description and/or illustrated in drawings. Rather, the description and/or the drawings provide examples of the embodiments envisioned, but the claims are not limited to any particular embodiment or a preferred embodiment disclosed and/or identified in the specification. Any drawing figures that may be provided are for illustrative purposes only, and merely provide practical examples of the invention disclosed herein. Therefore, any drawing figures provided should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations.

Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

What is claimed is:

1. A multi-slicing foodstuff device comprises:

a top plate mutually coupled with a bottom plate, the top plate and the bottom plate forming a housing and having a recess formed between the top plate and the bottom plate;

a planar cutting blade, the cutting blade is housed within the recess;

a guide arm coupled with the planar cutting blade, the guide arm manually controlling reciprocating movement of the cutting blade;

a plurality of apertures formed in the top plate and the bottom plate, the plurality of apertures in the top plate are mutually aligned in an axial orientation relative to the plurality of apertures in the bottom plate, wherein the cutting blade comprises a plurality of apertures formed therein, the plurality of apertures being equal in number and diameter with the plurality of apertures in the top plate and in the bottom plate, wherein the plurality of apertures of the cutting blade is mutually alignable in axial orientation with the plurality of apertures in the top plate and in the bottom plate; and a handle formed at a proximal end of the multi-slicing foodstuff device.

2. The device of claim 1, wherein the top plate and the bottom plate each includes an end wall from which a respective appendage extends integrally coplanar therefrom, wherein the appendage of the top plate and the appendage of the bottom plate collectively form the handle.

3. The device of claim 1 further comprising a plurality of stops for controlling a linear cutting distance of the cutting blade.

4. The device of claim 3, wherein the plurality of stops comprises a proximal stop and a distal stop disposed within and between the top plate and the bottom plate.

5. A multi-slicing foodstuff assembly comprising:

a multi-slicing foodstuff device, the multi-slicing foodstuff device comprising:

a top plate mutually coupled with a bottom plate, the top plate and the bottom plate forming a housing and having a recess formed between the top plate and the bottom plate;

a planar cutting blade, the cutting blade is housed within the recess;

a guide arm coupled with the planar cutting blade, the guide arm manually controlling reciprocating movement of the cutting blade;

a plurality of apertures formed in the top plate and the bottom plate, the plurality of apertures in the top plate are mutually aligned in an axial orientation relative to the plurality of apertures in the bottom plate, wherein the cutting blade comprises a plurality of apertures formed therein, the plurality of apertures being equal in number and diameter with the plurality of apertures in the top plate and in the bottom plate, wherein the plurality of apertures of the cutting blade is mutually alignable in axial orientation with the plurality of apertures in the top plate and in the bottom plate;

a handle formed at a proximal end of the multi-slicing foodstuff device; and a stabilizer assembly comprises a stabilizer for supporting the multi-slicing foodstuff device in an elevated, fixed orientation.

6. The multi-slicing foodstuff assembly of claim 5, wherein the stabilizer assembly comprises a top wall comprising an enlarged void defined therethrough and a rear edge, a rear vertical wall mounted orthogonal to a lower surface, a first vertical sidewall mounted perpendicular to one end of the top wall, and a second vertical sidewall mounted perpendicular to an opposing end of the top wall.

7. The multi-slicing foodstuff assembly of claim 6, wherein the first vertical sidewall, the second vertical sidewall, and the top wall collectively form a support compartment within which the multi-slicing foodstuff device seats in a snug-fit, planar orientation.

8. The multi-slicing foodstuff assembly of claim 7, wherein the first vertical sidewall and the second vertical sidewall each comprises a handle receiving recess.

9. The multi-slicing foodstuff assembly of claim 6, further comprising a pivoting platform which is pivotally mounted via a hinge mechanism to a planar lower surface of the top wall, proximate the rear vertical wall, and wherein the pivoting platform accommodated by and occupying the enlarged void of the top wall.

10. The multi-slicing foodstuff assembly of claim 9, wherein the hinge mechanism, in a resting position, is biased so as to urge the pivoting platform in a coplanar relationship with the top wall.

11. The multi-slicing foodstuff assembly of claim 9, further comprising a first linearly-elongated handle member and a second linearly-elongated handle member mounted to a planar lower surface of the pivoting platform, proximate opposing side edges of the pivoting platform, in a distal and parallel orientation.

12. The multi-slicing foodstuff assembly of claim 11, wherein the first linearly-elongated handle member and the second linearly-elongated handle member are manually depressible to pivot the pivoting platform downwardly to a fully declined orientation.

* * * * *